US011355887B2

(12) United States Patent
Tanaka et al.

(10) Patent No.: US 11,355,887 B2
(45) Date of Patent: Jun. 7, 2022

(54) CONNECTOR WITH RESTRICTION MEMBER FOR LATCH STRUCTURE AND WIRE HARNESS HAVING SAME

(71) Applicant: Yazaki Corporation, Tokyo (JP)

(72) Inventors: Yasuhiro Tanaka, Shizuoka (JP); Hiroki Kitagawa, Shizuoka (JP); Masanobu Higashitani, Shizuoka (JP); Kengo Machida, Shizuoka (JP); Maho Shinohara, Shizuoka (JP); Masatoshi Yamada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/879,731

(22) Filed: May 20, 2020

(65) Prior Publication Data

US 2020/0381861 A1 Dec. 3, 2020

(30) Foreign Application Priority Data

May 27, 2019 (JP) ..... JP2019-098171

(51) Int. Cl.
*H01R 13/62* (2006.01)
*H01R 13/627* (2006.01)
*H01R 24/20* (2011.01)

(52) U.S. Cl.
CPC ..... *H01R 13/6271* (2013.01); *H01R 24/20* (2013.01)

(58) Field of Classification Search
CPC .. H01R 24/20; H01R 13/6271; H01R 13/627; H01R 13/62; H01R 13/60; H01R 13/6275; H01R 13/6272; H01R 13/6273
USPC ..... 439/350, 351–355, 358, 359
See application file for complete search history.

(56) References Cited

U.S. PATENT DOCUMENTS 3,467,942 A * 9/1969 Stoyer ..... H01R 13/432 439/293
3,671,921 A * 6/1972 Baker, III ..... H01R 13/502 439/353
4,370,013 A * 1/1983 Niitsu ..... H01R 13/6272 439/352
4,657,331 A * 4/1987 Coldren ..... H01R 13/639 439/571
5,104,253 A * 4/1992 Zielinski ..... H01R 13/6272 403/329

(Continued)

FOREIGN PATENT DOCUMENTS

CN 101499583 A 8/2009
JP 2014-26827 A 2/2014

*Primary Examiner* — Harshad C Patel
(74) *Attorney, Agent, or Firm* — Kenealy Vaidya LLP

(57) ABSTRACT

A connector applied to a wire harness includes a housing housing a terminal, a front holder assembled to an end portion in an axial direction of the housing, and a restriction member assembled to the housing. One of the housing and the front holder has a latch claw portion that latches the housing and the front holder. The other of the housing and the front holder has a latch arm portion extending along the axial direction and latched to the latch claw portion. The restriction member has a restriction piece that is located adjacent to the latch arm portion that is in a state of being latched to the latch claw portion, the restriction piece restricting displacement of the latch arm portion toward a latch release side.

10 Claims, 6 Drawing Sheets

(56) References Cited

U.S. PATENT DOCUMENTS

| | | | | |
|---|---|---|---|---|
| 5,391,092 | A * | 2/1995 | Sumida | H01R 13/516 439/470 |
| 5,697,806 | A | 12/1997 | Whiteman, Jr. et al. | |
| 6,140,722 | A * | 10/2000 | Ballard | H02K 5/225 310/68 D |
| 7,021,959 | B2 * | 4/2006 | Tsuji | H01R 13/562 439/470 |
| 7,892,045 | B2 * | 2/2011 | Ratzlaff | H01R 13/5025 439/701 |
| 9,128,410 | B2 * | 9/2015 | Suzuki | G03G 21/181 |
| 10,249,976 | B1 * | 4/2019 | Thomas | H01R 13/506 |
| 10,573,988 | B2 * | 2/2020 | Mellott | H01R 13/113 |
| 10,734,750 | B2 * | 8/2020 | Yamanashi | H01R 13/5205 |
| 2001/0016457 | A1 * | 8/2001 | Taguchi | H01R 13/4367 439/752 |
| 2008/0009201 | A1 * | 1/2008 | Hiramatsu | H01R 13/4365 439/752 |
| 2009/0191749 | A1 | 7/2009 | Mase et al. | |
| 2015/0104963 | A1 | 4/2015 | Saitoh | |

* cited by examiner

CONNECTOR WITH RESTRICTION MEMBER FOR LATCH STRUCTURE AND WIRE HARNESS HAVING SAME

CROSS-REFERENCE TO RELATED APPLICATION(S)

The present application claims priority to and incorporates by reference the entire contents of Japanese Patent Application No. 2019-098171 filed in Japan on May 27, 2019.

BACKGROUND OF THE INVENTION

1. Field of the Invention

The present invention relates to a connector and a wire harness.

2. Description of the Related Art

As a conventional connector that is applied to a vehicular wire harness or the like, Japanese Patent Application Laid-open No. 2014-026827 discloses a connector that includes a female terminal housing and a male terminal housing, for example. In the female housing, a plurality of terminal housing chambers in which each female terminal is inserted and housed are formed. The male housing holds a plurality of male terminals that are connected to the female terminals. The connector allows the male terminal housing to fit the female terminal housing and allows the male terminals to connect, in a sliding contact manner, to contact members of the female terminals.

Incidentally, in the connector described in the above-described Japanese Patent Application Laid-open No. 2014-026827, a front holder may be assembled to the housing. In such a connector, there is room for further improvement in the configuration of more properly assembling components such as the housing, the front holder, or the like, for example.

SUMMARY OF THE INVENTION

The present invention has been made in view of the above-described circumstances, and an object of the invention is to provide a connector and a wire harness that can assemble the components properly.

In order to achieve the above mentioned object, a connector according to one aspect of the present invention includes a housing configured to house therein a terminal along an axial direction; a front holder assembled to an end portion in the axial direction of the housing, the front holder being configured to hold the terminal between the housing and the front holder in the axial direction; and a restriction member assembled to the housing, wherein one of the housing and the front holder includes a latch claw portion configured to latch the housing and the front holder, the other of the housing and the front holder includes a latch arm portion extending along the axial direction, the latch arm portion being configured to be latched to the latch claw portion in a state where the housing and the front holder are assembled, and the restriction member includes, in a state of being assembled to the housing, a restriction piece that is located adjacent to the latch arm portion that is in a state of being latched to the latch claw portion, the restriction piece being configured to restrict displacement of the latch arm portion toward a latch release side.

According to another aspect of the present invention, in the connector, it is possible to configure that the housing includes an opening formed at an end portion on the opposite side to the front holder side in the axial direction, and the restriction member is assembled to the opening and closes the opening.

According to still another aspect of the present invention, in the connector, it is possible to configure that the restriction member includes an outer-peripheral wall portion formed around an axis along the axial direction, and the restriction piece is formed so as to project along the axial direction from the outer-peripheral wall portion.

In order to achieve the above mentioned object, a wire harness according to still another aspect of the present invention includes a wiring material having conductivity; and a connector electrically connected to the wiring material, wherein the connector includes a housing configured to house therein a terminal electrically connected to the wiring material along an axial direction, a front holder assembled to an end portion in the axial direction of the housing, the front holder being configured to hold the terminal between the housing and the front holder in the axial direction, and a restriction member assembled to the housing, one of the housing and the front holder includes a latch claw portion configured to latch the housing and the front holder, the other of the housing and the front holder includes a latch arm portion extending along the axial direction, the latch arm portion being configured to be latched to the latch claw portion in a state where the housing and the front holder are assembled, and the restriction member includes, in a state of being assembled to the housing, a restriction piece that is located adjacent to the latch arm portion that is in a state of being latched to the latch claw portion, the restriction piece being configured to restrict displacement of the latch arm portion toward a latch release side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes in detail an exemplary embodiment according to the present invention based on the accompanying drawings. The invention, however, is not intended to be limited by the embodiment. The constituent elements in the following embodiment include elements that are substitutable and easily achieved by a person skilled in the art, or elements that are substantially the same as the constituent elements.

Figure 1:
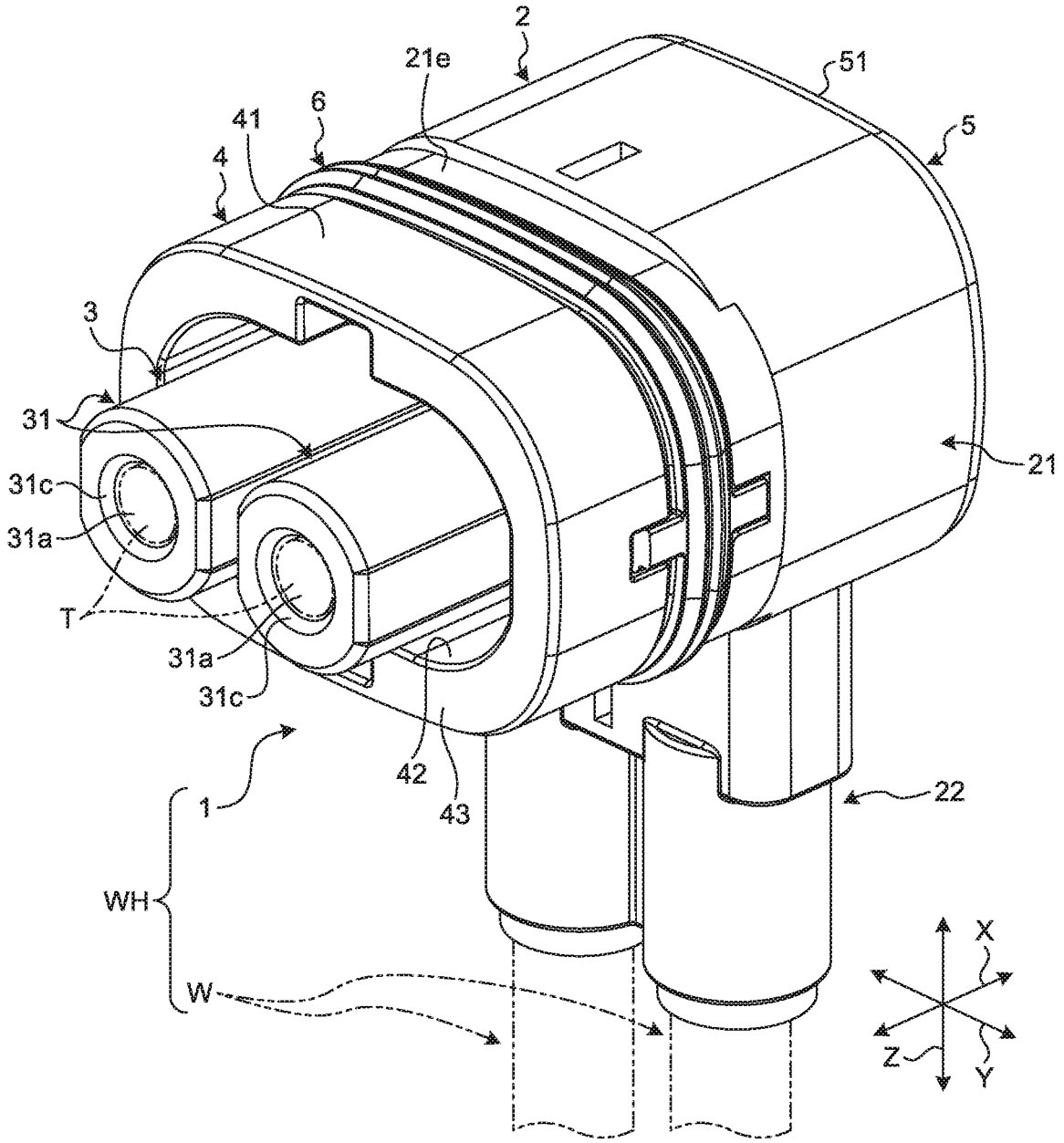
FIG. 1 is a perspective view representing a schematic configuration of a connector according to an embodiment.
Figure 2:
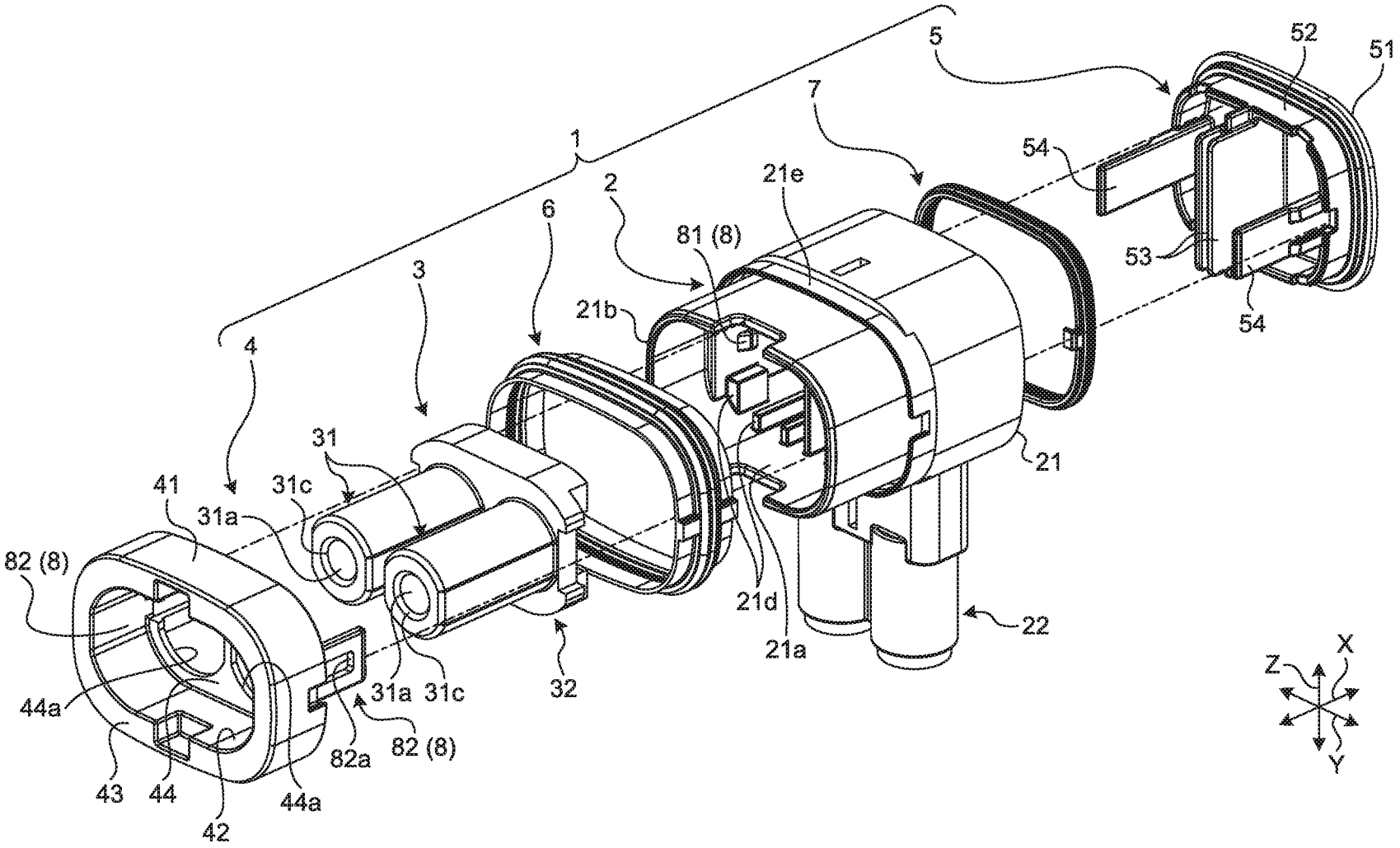
FIG. 2 is an exploded perspective view representing a schematic configuration of the connector in the embodiment.
Figure 3:
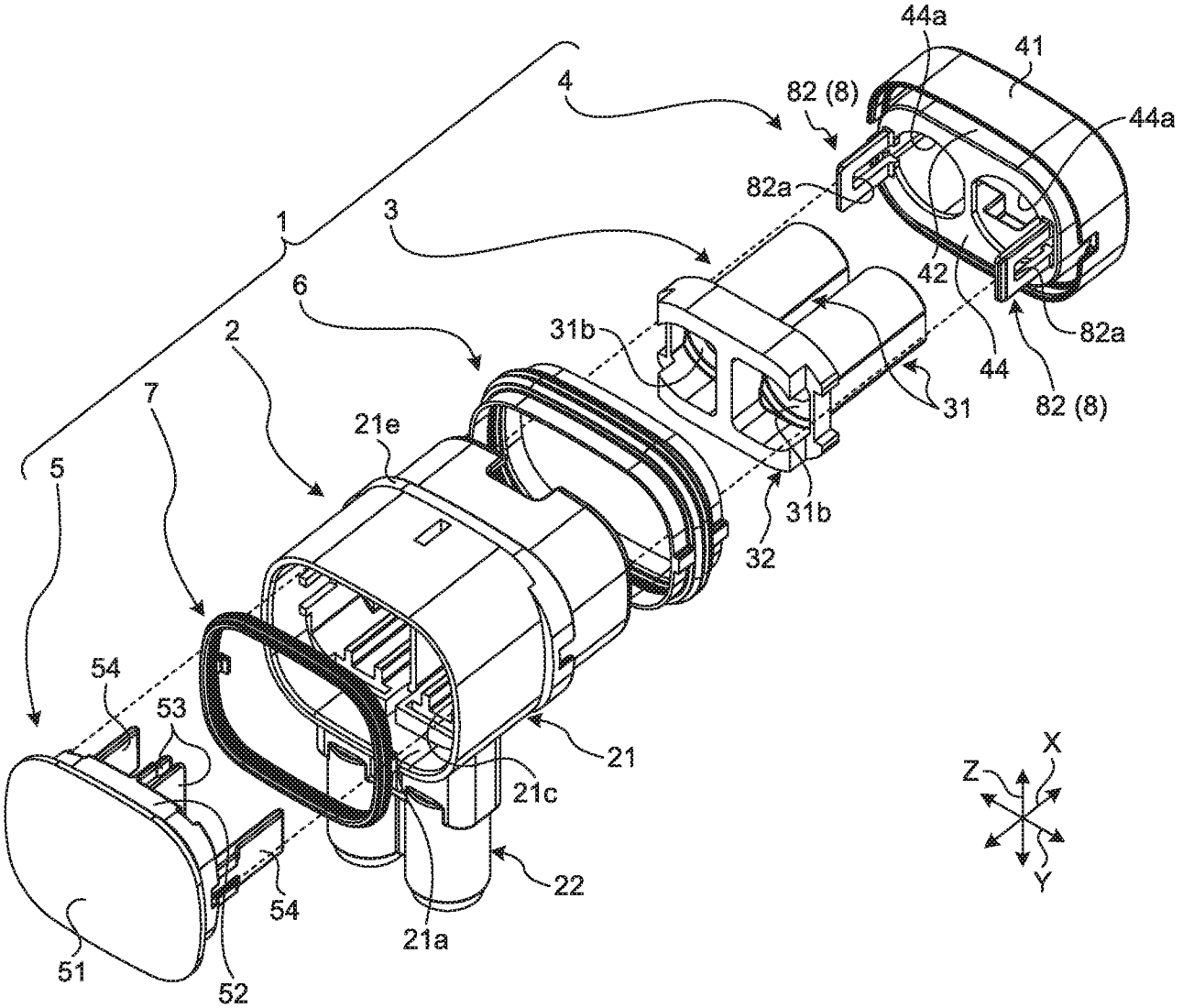
FIG. 3 is an exploded perspective view representing a schematic configuration of the connector in the embodiment.
Figure 4:
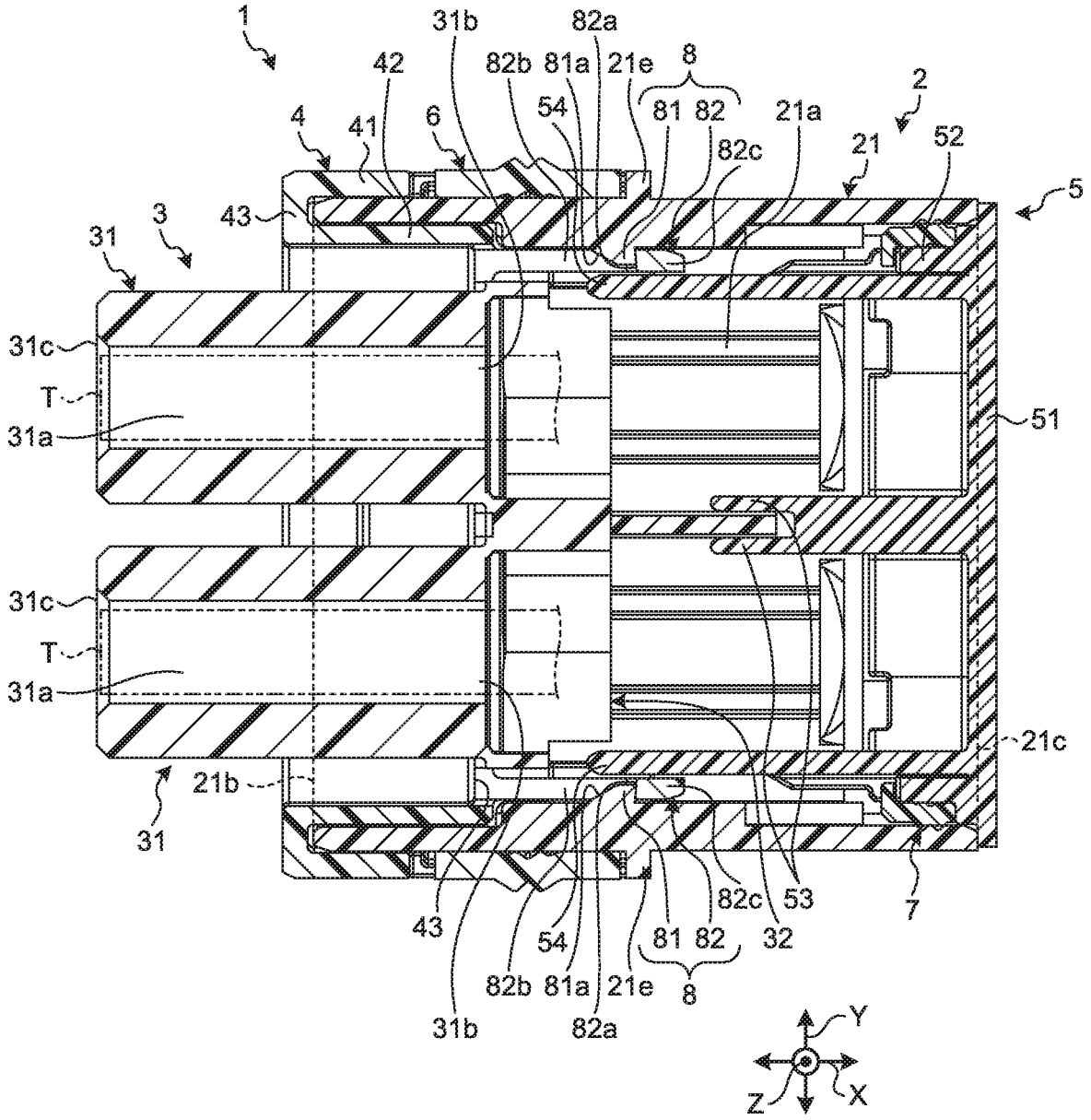
FIG. 4 is a cross-sectional view including latch mechanisms and restriction pieces that are included in the connector in the embodiment.

In FIG. 1 in the following description, only a part of a plurality of wiring materials is depicted by omission with long-dashed double-dotted lines, and in the other drawings, the depiction of the wiring materials is omitted. In FIG. 1 and FIG. 4, only a part of terminals is depicted by omission with long-dashed double-dotted lines, and in the other drawings, the depiction of the terminals is omitted. In the following description, out of a first direction, a second direction, and a third direction intersecting with one another, the first direction is referred to as an "axial direction X", the second direction is referred to as a "width direction Y", and the third direction is referred to as a "height direction Z". In this case, the axial direction X, the width direction Y, and the height direction Z are orthogonal to one another. The axial direction X is, typically, a direction along a connector fitting direction of a connector to a connection counterpart and is, more precisely, a direction along an insertion direction of a terminal to a housing space portion of the connector. The directions used in the following description respectively represent the directions in a state in which various portions are assembled with one another, unless otherwise specifically noted.

Embodiment

A connector 1 according to the present embodiment illustrated in FIG. 1, FIG. 2, FIG. 3, and FIG. 4 is applied to a wire harness WH or the like that is used for an automobile and the like, for example. The wire harness WH is, for example, a component assembly obtained by bundling a plurality of wiring materials W that are used for power supply and signal communication for the connection among various devices installed on the vehicle, and connects the wiring materials W to the respective devices via a connector and the like. The wire harness WH includes wiring materials W having conductivity, and the connector 1 that is electrically connected to the wiring materials W. The wiring materials W are each made up of electric wires for which the outside of a conductor portion (core wire) made of a plurality of conductive metal wires is covered with an insulation sheathing portion, an electric wire bundle for which the electric wires are bundled, a metal rod for which the outside of a conductive rod-like member is covered with an insulation sheathing portion, and the like, for example. The wire harness WH may further include, in addition to the foregoing, a grommet, a protector, a fastener, an electrical connection box, or the like.

The connector 1 of the present embodiment typically constitutes a connection device for wiring-material-to-device that connects with a device, such as an inverter, or the like serving as a connection counterpart and electrically connects the wiring materials W and the connection counterpart. The connector 1 forms, by being fitted in a fitting hole formed on a housing or the like of the connection counterpart, an electrical connection region between the connection counterpart and the connector 1. The connector 1 of the present embodiment, in such a configuration, achieves a configuration in which a housing 2 and a front holder 4 that are components can be assembled properly. The following describes in detail the configuration of the connector 1 with reference to the respective drawings.

Specifically, the connector 1 includes the housing 2, an inner housing 3, the front holder 4, a rear cover 5 serving as a restriction member, and packings 6 and 7. In the following description, in the connector 1, a connection counterpart side in the axial direction X may be referred to as a front side and an opposite side in the axial direction X may be referred to as a rear side.

The housing 2 is a member that houses therein terminals T along the axial direction X. The housing 2 of the present embodiment houses and holds the terminals T along the axial direction X via the inner housing 3 provided in the inside. The terminal T is a metal fitting made up of metallic material having conductivity. The terminal T is a female terminal that is electrically connected to a male counterpart terminal, for example. The terminal T is electrically connected to a terminal of the wiring material W. A plurality of terminals T are provided, and in this case, two are provided. The housing 2 includes a body portion 21 and a wiring-material insertion portion 22 and these are integrally formed by resin material having insulating properties.

The body portion 21 is formed in a substantially long cylindrical shape for which a central axis line lies along the axial direction X. The body portion 21 is formed in an outer shape for which an end portion of the front side in the axial direction X can be fitted in a fitting hole of a connection counterpart. The body portion 21 houses the inner housing 3 and the like in an inner space portion 21*a* in the inside. In the body portion 21, both end portions in the axial direction X are open and constitute respective openings 21*b* and 21*c*. The opening 21*b* is an opening formed at the front side end portion in the axial direction X of the body portion 21. The front side end portion of the body portion 21 is the end portion on the side to which the front holder 4 is attached, and is the end portion on the side that is fitted in the fitting hole of the connection counterpart. The opening 21*b* exposes the inner housing 3 in the inner space portion 21*a* toward the front side in the axial direction X externally. Meanwhile, the opening 21*c* is an opening formed at the rear side end portion in the axial direction X of the body portion 21. The rear side end portion of the body portion 21 is the end portion on the opposite side to the front holder 4 side in the axial direction X (end portion on the opposite side to the side to which the front holder 4 is attached). The opening 21*c* is an opening formed to pull out a die for molding the housing 2 along the axial direction X and is closed by the rear cover 5 described later. In the body portion 21, a partition wall portion 21*d* (see also FIG. 6, for example) is formed in the inner space portion 21*a* and a flange portion 21*e* is formed on the outer circumferential surface. The partition wall portion 21*d* is a wall portion that sandwiches and holds the inner housing 3 between the front holder 4 and the partition wall portion 21*d*. The flange portion 21*e* is an annular projecting portion that sandwiches and holds the packing 6 between the front holder 4 and the flange portion 21*e*. The packing 6 is a water stop member that is annularly formed and is attached on the outer circumferential surface of the body portion 21. The packing 6 is, in a state where the connector 1 is fitted in the fitting hole of the connection counterpart, interposed between the outer circumferential surface of the body portion 21 and the wall surface of the fitting hole and comes into contact with the foregoing, thereby stopping water and ensuring sealing.

The wiring-material insertion portion 22 is a portion through which the wiring materials W are inserted. The wiring-material insertion portion 22 is formed so as to project toward one side along the height direction Z from a vicinity of the rear side end portion in the axial direction X of the body portion 21. The wiring-material insertion portion 22 is formed in a tubular shape, and the wiring materials W are inserted along the height direction Z via the inside. That is, the housing 2 holds the terminals T along the axial direction X and also, along the height direction Z orthogonal to the axial direction X, the wiring materials W are inserted. In this case, two wiring materials W are inserted through the wiring-material insertion portion 22. The wiring materials W inserted to the inner space portion 21*a* via the wiring-material insertion portion 22 are electrically connected to respective terminals T held in the inner housing 3 via relay terminals, a relay bus bar, or the like, for example.

The inner housing 3 is a member formed separate from the housing 2, and is a member that is provided in the inner space portion 21*a* of the housing 2 and that houses and holds the terminals T along the axial direction X. The inner housing 3 is, in the inner space portion 21*a*, held between the housing 2 and the front holder 4 in the axial direction X. The inner housing 3 includes tubular body portions 31 and a base portion 32 and these are integrally formed by resin material having insulating properties.

The tubular body portion 31 is formed in a substantially cylindrical shape for which a central axis line lies along the axial direction X. The tubular body portion 31 houses and holds the terminal T along the axial direction X in a housing space portion 31*a* inside (see FIG. 4, for example). The housing space portion 31*a* is a space portion constituting a terminal insertion chamber (cavity) to which the terminal T is inserted along the axial direction X. In the tubular body portion 31, both end portions in the axial direction X are open and constitute respective openings 31*b* and 31*c*. The opening 31*b* is an opening formed at the rear side end portion in the axial direction X of the tubular body portion 31. In the tubular body portion 31, the terminal T is inserted to the housing space portion 31*a* from the opening 31*b* and the terminal T is held in the housing space portion 31*a*. The tubular body portion 31 latches the terminal T at a normal position in the housing space portion 31*a* by a lance or the like that is formed facing the housing space portion 31*a*. Meanwhile, the opening 31*c* is an opening formed at the front side end portion in the axial direction X of the tubular body portion 31. In the tubular body portion 31, the counterpart terminal is inserted from the opening 31*c* and is connected to the terminal T in the housing space portion 31*a*. The tubular body portions 31 the number of which corresponds to the number of terminals T are provided, and in this case, two are provided. The two tubular body portions 31 are positioned in juxtaposition along the width direction Y and are coupled by the base portion 32.

The base portion 32 is a portion that couples the two tubular body portions 31, and couples the rear side end portions in the axial direction X of the two tubular body portions 31. The base portion 32 is, in the inner housing 3, also a portion that is sandwiched and held between the partition wall portion 21*d* of the housing 2 and the front holder 4 (see also FIG. 6, for example). In the base portion 32, a space portion is formed so as to face the opening 31*b* of each tubular body portion 31 and be continuous with the housing space portion 31*a*. The inner housing 3 is, in the inner space portion 21*a*, positioned such that the tubular body portion 31 is on the front side in the axial direction X and such that the base portion 32 is on the rear side in the axial direction X. In the inner housing 3, with this positional relation, the tubular body portion 31 is exposed externally via the opening 21*b* and the base portion 32 is held between the partition wall portion 21*d* of the housing 2 and the front holder 4 (see also FIG. 6, for example).

The front holder 4 is a member formed separate from the housing 2, and is a member that holds the inner housing 3 and the packing 6 between the housing 2 and the front holder 4. The front holder 4 in the present embodiment is assembled to the front side end portion in the axial direction X of the body portion 21 of the housing 2. The front holder 4 holds the terminals T between the housing 2 and the front holder 4 via the inner housing 3 in the axial direction X. The front holder 4 includes an outer barrel portion 41, an inner barrel portion 42, and a pair of end wall portions 43 and 44, and these are integrally formed by resin material having insulating properties.

The outer barrel portion 41 and the inner barrel portion 42 are formed in a substantially long cylindrical shape for which a central axis line lies along the axial direction X. In the front holder 4, the outer barrel portion 41 is positioned on the outside of the inner barrel portion 42, and in other words, the inner barrel portion 42 is positioned on the inner side of the outer barrel portion 41. The outer barrel portion 41 is formed so as to have an inner diameter that can tightly adhere to the outer circumferential surface of the front side end portion in the axial direction X of the body portion 21. The outer barrel portion 41 is formed in an outer shape that can be fitted in the fitting hole of the connection counterpart. The inner barrel portion 42 is formed so as to have an outer diameter that can tightly adhere to the inner circumferential surface of the front side end portion in the axial direction X of the body portion 21. In the outer barrel portion 41 and the inner barrel portion 42, both end portions in the axial direction X are open. The end wall portion 43 is formed in a substantially long annular plate shape for which a central axis line lies along the axial direction X, and connects the front side end portion in the axial direction X of the outer barrel portion 41 and the front side end portion in the axial direction X of the inner barrel portion 42. The end wall portion 43 is connected to the outer barrel portion 41 on the outer diameter side and is connected to the inner barrel portion 42 on the inner diameter side. The end wall portion 44 is formed in a substantially long disk shape for which a central axis line lies along the axial direction X, and is provided in the opening formed at the rear side end portion in the axial direction X of the inner barrel portion 42. The end wall portion 44 is connected to the inner barrel portion 42 on the outer diameter side. In the end wall portion 44, insertion holes 44*a* are formed. The insertion hole 44*a* is, in the end wall portion 44, a through-hole through which the tubular body portion 31 of the inner housing 3 is inserted along the axial direction X. The insertion hole 44*a* is formed in a substantially circular shape. The insertion holes 44*a* the number of which corresponds to the number of tubular body portions 31 are provided, and in this case, two are provided. The two insertion holes 44*a* are positioned in juxtaposition along the width direction Y.

The front holder 4 is assembled to the housing 2 in the positional relation in which the front side end portion in the axial direction X of the body portion 21 is inserted between the outer barrel portion 41 and the inner barrel portion 42 and in which each of the tubular body portions 31 is inserted to the respective insertion holes 44*a*. The front holder 4, in a state of being assembled to the housing 2, holds the inner housing 3 between the partition wall portion 21*d* of the housing 2 and the end wall portion 44 and holds the packing 6 between the flange portion 21*e* of the housing 2 and the rear side end portion in the axial direction X of the outer barrel portion 41 (see also FIG. 6, for example).

Then, the front holder 4 is, in a state of being assembled to the front side end portion in the axial direction X of the body portion 21 of the housing 2, latched to the housing 2 via a latch mechanism 8. The latch mechanism 8 includes latch claw portions 81 and latch arm portions 82 that are latched by the latch claw portions 81. One of the housing 2 and the front holder 4 has the latch claw portions 81 and the other of the housing 2 and the front holder 4 has the latch arm portions 82. In the connector 1 of the present embodiment, the housing 2 has the latch claw portions 81 and the front holder 4 has the latch arm portions 82.

The latch claw portion 81 is a protrusion to latch the housing 2 and the front holder 4 and is a portion that the latch arm portion 82 is latched. The latch claw portions 81 are, in the body portion 21 of the housing 2, formed on the inner wall surface facing the inner space portion 21*a* (see also FIG. 5, for example). In this case, the latch claw portions 81 are provided one each, a total of two, on the inner wall surface on both sides in the width direction Y of the body portion 21. The two latch claw portions 81 are positioned facing each other along the width direction Y. Each latch claw portion 81 is formed in a claw shape protruding on the inner side (the inner space portion 21*a* side) along the width direction Y from each inner wall surface of the body portion 21 (see FIG. 4 and FIG. 5, for example). Each latch claw portion 81 has an inclined surface 81*a* formed on the front side end portion thereof in the axial direction X. The inclined surface 81*a* constitutes a guide surface for guiding the distal end portion of the latch arm portion 82 along the axial direction X.

The latch arm portion 82 extends along the axial direction X and is, in a state where the housing 2 and the front holder 4 are assembled, a portion to be latched to the latch claw portion 81. The latch arm portion 82 is formed on the end wall portion 44 of the front holder 4. In this case, in the end wall portion 44, the latch arm portions 82 are provided one each, a total of two, on both sides in the width direction Y of the insertion hole 44*a*. The two latch arm portions 82 are positioned facing each other across the insertion hole 44*a* along the width direction Y. The latch arm portions 82 are positioned so as to face the respective latch claw portions 81 along the axial direction X. Each latch arm portion 82 is formed so as to project in an arm shape toward the rear side along the axial direction X from the end wall portion 44. That is, in each latch arm portion 82, the base portion that is the front side end portion in the axial direction X is fixed to and supported on the end wall portion 44 and the distal end portion that is the rear side end portion in the axial direction X is a free end. As a result, each latch arm portion 82 is supported in a cantilever form that is elastically deformable along the width direction Y with respect to the end wall portion 44. In this case, each latch arm portion 82 is formed as a hook portion in a substantially U-shaped form that can be latched to the latch claw portion 81, and a latching surface 82*a* is formed at the distal end portion (see FIG. 4 and FIG. 5, for example). More specifically, each latch arm portion 82 is formed in a substantially U-shaped form by a pair of arm portions 82*b* and a beam portion 82*c*. The pair of arm portions 82*b* are portions extending along the axial direction X and positioned at a distance along the height direction Z. The beam portion 82*c* is a portion that connects distal end portions of the pair of arm portions 82*b*, and the surface on the front side in the axial direction X constitutes the above-described latching surface 82*a*.

Figure 5:
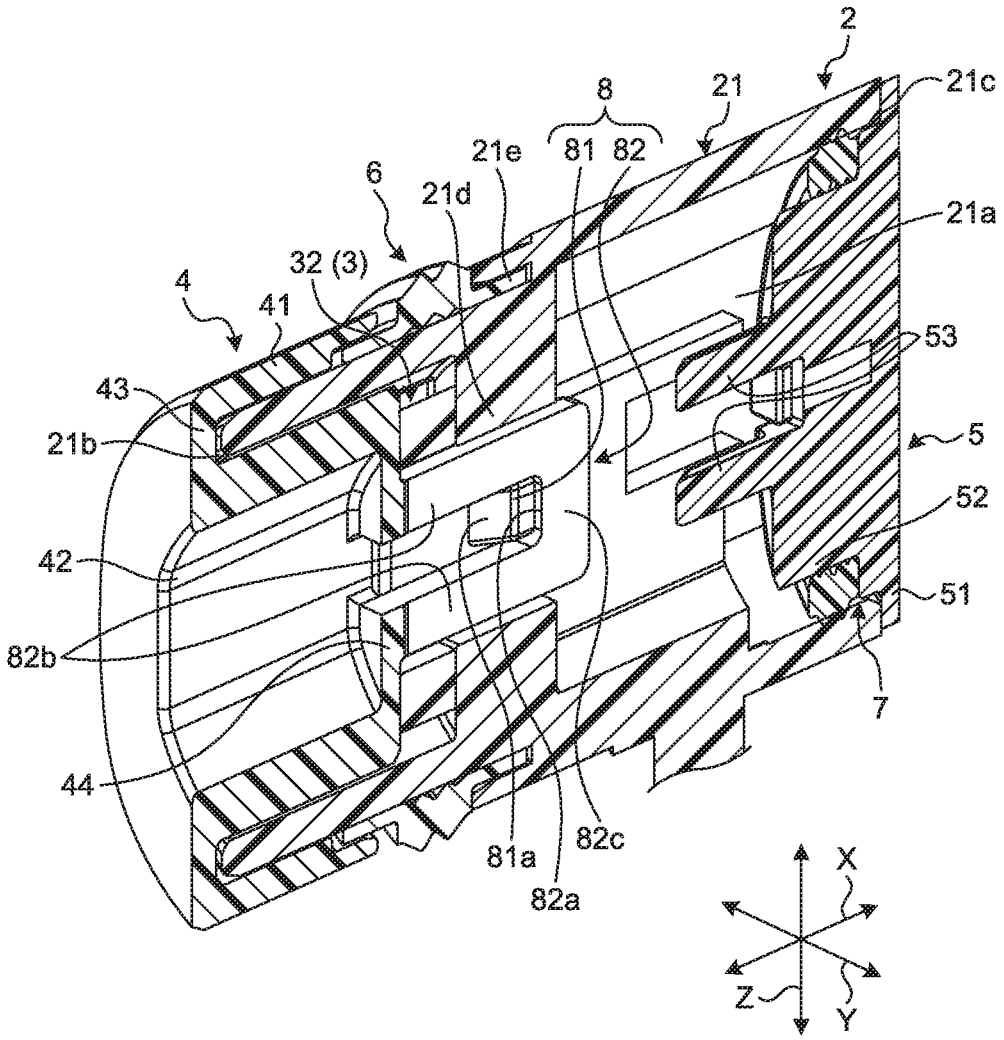
FIG. 5 is a cross-sectional perspective view seeing the latch mechanism that is included in the connector in the embodiment.

Each latch arm portion 82 moves to the latching position indicated in FIG. 4 and FIG. 5, with the operation of assembling the front holder 4 to the housing 2 along the axial direction X, as the beam portion 82*c* (distal end portion) is guided by the inclined surface 81*a* and climbs over the latch claw portion 81 with the entire latch arm portion 82 bending in the width direction Y. As a result, in each latch arm portion 82, the latching surface 82*a* is latched to the latch claw portion 81. Thus, the front holder 4 is, in a state of being assembled to the housing 2 in the above-described positional relation, latched to the housing 2.

The rear cover 5 is a member formed separate from the housing 2, is assembled to the opening 21*c* of the housing 2 together with the packing 7, and is a member that closes the opening 21*c*. The rear cover 5 of the present embodiment is assembled to the housing 2 separately from the front holder 4 and is also used as a restriction member that restricts excessive deforming of the latch arm portion 82. The rear cover 5 includes a plate-like portion 51, an outer-peripheral wall portion 52, insulation plates 53, and restriction pieces 54 and these are integrally formed by resin material having insulating properties.

The plate-like portion 51 is a main portion that closes the opening 21*c*. The plate-like portion 51 is formed in a substantially long disk shape for which a central axis line lies along the axial direction X. The outer-peripheral wall portion 52 is a substantially long annular frame-like wall portion formed around the central axis along the axial direction X. The outer-peripheral wall portion 52 is provided to stand on the surface on the front side in the axial direction X of the plate-like portion 51. The outer-peripheral wall portion 52 is formed at a position offset from the edge of the plate-like portion 51 along the edge. In the outer-peripheral wall portion 52, the packing 7 is attached on the outer circumferential surface. The packing 7 is annularly formed and is a water stop member that is attached on the outer circumferential surface of the outer-peripheral wall portion 52 of the rear cover 5. The packing 7 is, in a state where the rear cover 5 is assembled to the opening 21*c*, interposed between the outer circumferential surface of the outer-peripheral wall portion 52 and the wall surface of the opening 21*c* and comes into contact with the foregoing, thereby stopping water and ensuring sealing. The insulation plate 53 is a wall portion provided to stand on the surface on the front side in the axial direction X of the plate-like portion 51. The insulation plate 53 is formed in a substantially rectangular plate-like shape for which the width direction Y is the thickness direction, and extends along the axial direction X and the height direction Z. Two pieces of the insulation plates 53 are, on the surface on the front side in the axial direction X of the plate-like portion 51, provided at substantially the center in the width direction Y. Each insulation plate 53 is, in a state where the rear cover 5 is assembled to the opening 21*c*, interposed between the two terminals T, and relay terminals, a bus bar, and the like that are connected to the respective terminals T and insulates them mutually.

Figure 6:
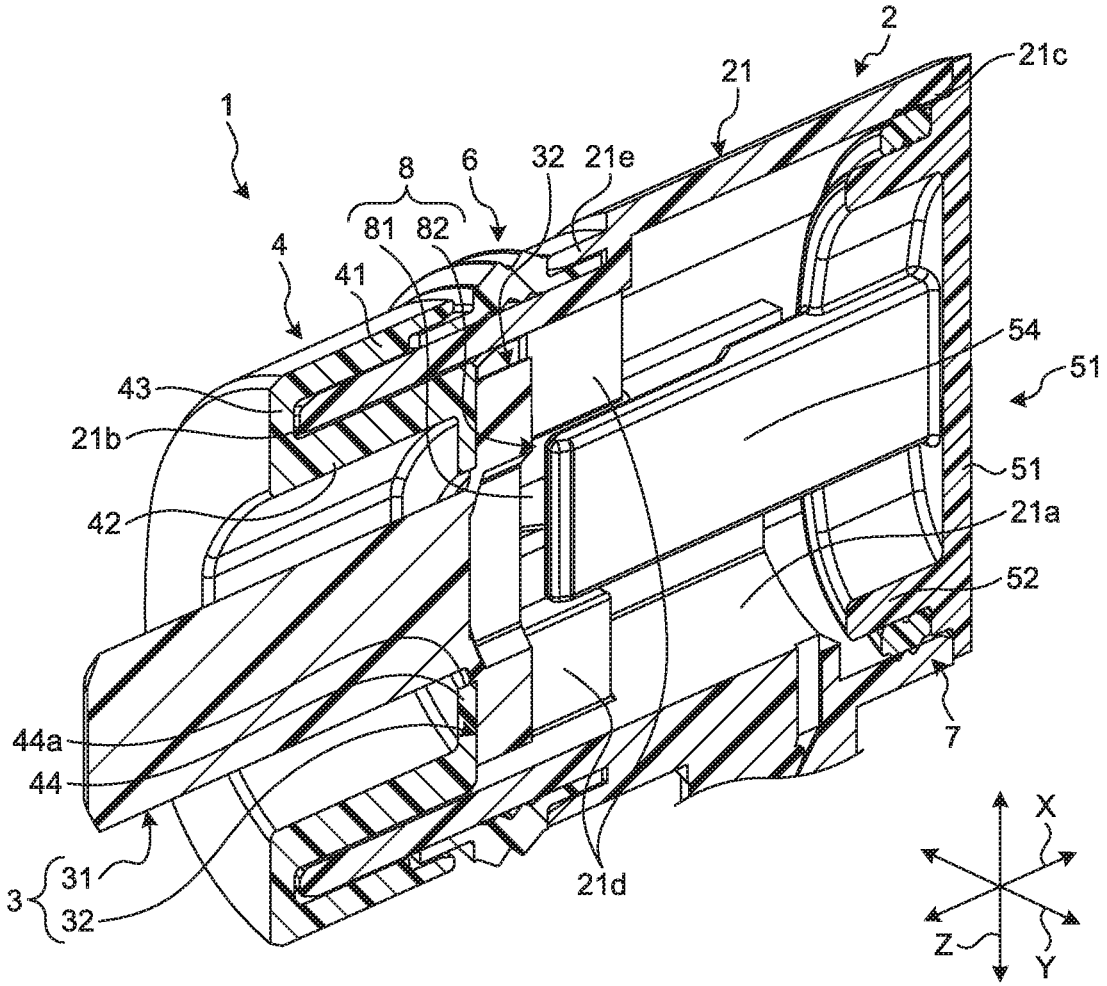
FIG. 6 is a cross-sectional perspective view seeing the latch mechanism and the restriction piece that are included in the connector in the embodiment.

The restriction piece 54 of the present embodiment is, in a state where the rear cover 5 is assembled to the housing 2, a portion located adjacent to the latch arm portion 82 that is in a state of being latched to the latch claw portion 81, as illustrated in FIG. 4 and FIG. 6. The restriction piece 54 restricts the displacement of the latch arm portion 82 toward the latch release side. In this case, the restriction piece 54 is formed as a plate-like wall portion provided to stand on the surface on the front side in the axial direction X of the plate-like portion 51. The restriction piece 54 is formed in a substantially rectangular plate-like shape for which the width direction Y is the thickness direction, and extends along the axial direction X and the height direction Z. In other words, the restriction piece 54 is a belt-like plate piece formed so as to project toward the front side in the axial direction X from the surface on the front side in the axial direction X of the plate-like portion 51. The restriction pieces 54, on the surface on the front side in the axial direction X of the plate-like portion 51, are provided one each, a total of two, on both end portions in the width direction Y. The two restriction pieces 54 are positioned so as to face each other along the width direction Y. The restriction pieces 54 are each, in a state where the rear cover 5 is assembled to the housing 2, formed at a position facing, along the width direction Y, a portion (the beam portion 82*c*) in the vicinity of the latching surface 82*a* of the corresponding latch arm portion 82 on the inner side (the inner space portion 21*a* side) in the width direction Y of the respective latch arm portions 82. In this case, each restriction piece 54 is formed so as to project along the axial direction X from the outer-peripheral wall portion 52. That is, in each latch arm portion 82, the base portion that is the rear side end portion in the axial direction X is fixed to and supported on the outer-peripheral wall portion 52, and the distal end portion that is the front side end portion in the axial direction X is located adjacent to the latch claw portion 81 and the latch arm portion 82 in the width direction Y.

The rear cover 5 is assembled to the opening 21*c* of the housing 2 after the front holder 4 is assembled to the housing 2. The rear cover 5, in a state of being assembled to the opening 21*c* of the housing 2, holds the packing 7 between the outer circumferential surface of the outer-peripheral wall portion 52 and the wall surface of the opening 21*c*. In the rear cover 5, in this state, as illustrated in FIG. 4 and FIG. 6, each restriction piece 54 is located adjacent to the latch arm portion 82 that is in a state of being latched to the latch claw portion 81 on the inner side in the width direction Y of the latch arm portion 82. This configuration enables the rear cover 5 to function as a restriction member that restricts excessive deforming of the latch arm portion 82. Although depiction is omitted, the connector 1 further includes a fixing structure that fixes the rear cover 5 and the housing 2, in a state where the rear cover 5 is assembled to the opening 21*c*. The fixing structure can use various known locking structures, fastening structures, press-fit structures, or the like, for example.

The foregoing connector 1 and the wire harness WH allow, with the end portion on the front holder 4 side of the housing 2 fitting in and connecting via the connector to the fitting hole of the connection counterpart, the terminals T and the counterpart terminals to be electrically connected, so as to form an electrical connection region between the two. As a result, the wire harness WH allows the wiring materials W and the connection counterpart to be electrically connected via the connector 1. In such a configuration, the housing 2 and the front holder 4 are assembled to each other with the latch claw portion 81 and the latch arm portion 82 being latched together. The rear cover 5 can, in a state of being assembled to the housing 2, restrict by the restriction piece 54, the displacement of the latch arm portion 82 that is in a state of being latched to the latch claw portion 81 toward the latch release side, that is, the displacement toward the width direction Y side, as illustrated in FIG. 4 and FIG. 6. With this configuration, for example, during work of separating from a fitting hole of a connection counterpart, even when a load exerted on the front holder 4 causes the front holder 4 to be deformed in a twisting manner, thereby causing the latch arm portion 82 to be displaced toward the latch release side, the connector 1 can properly maintain the state where the latch arm portion 82 and the latch claw portion 81 are latched together. Consequently, the connector 1 can maintain the state where the housing 2 and the front holder 4 that are the components are properly assembled. As a result, the connector 1 and the wire harness WH can assemble the components properly.

In addition, in the foregoing connector 1 and the wire harness WH, the rear cover 5 that is a component separate from the housing 2 and the front holder 4, and closes the opening 21*c* can also be used as a restriction member on which the restriction pieces 54 are provided. As a result, the connector 1 and the wire harness WH can assemble the components properly as in the foregoing while restraining the number of components from increasing.

In this case, because the foregoing connector 1 and the wire harness WH have a configuration in which the restriction pieces 54 are formed so as to project from the outer-peripheral wall portion 52 of the rear cover 5, the base portion of the restriction piece 54 can be reinforced by the outer-peripheral wall portion 52. With this configuration, because the connector 1 or the wire harness WH can reliably restrict the displacement of the latch arm portion 82 toward the latch release side by the reinforced restriction piece 54, the components can be assembled more properly.

The connector and the wire harness in the above-described embodiment of the present invention are not limited to those in the foregoing embodiment, and various modifications can be made within the scope of the claims described in claims.

In the foregoing, although it has been described that the rear cover 5 is also used as a restriction member that restricts excessive deformation of the latch arm portions 82, the embodiments are not limited thereto. The restriction member may be configured as a member separate from the rear cover 5. For example, the restriction member may be, instead of the rear cover 5, what is called a rear holder that holds the terminals of the wiring materials W, or may be a dedicated member separate from those.

In the foregoing, although it has been described that the housing 2 houses and holds the terminals T along the axial direction X via the inner housing 3 that is housed in the inner space portion 21*a*, the embodiments are not limited thereto. The connector 1 may be in a configuration in which the inner housing 3 is not included.

In the foregoing, it has been described that, in the connector 1 has a configuration in which the housing 2 includes the latch claw portions 81 and the front holder 4 includes the latch arm portions 82. Inversely, however, the connector 1 may have a configuration in which the housing 2 includes the latch arm portions and the front holder 4 includes the latch claw portions.

While it has been described that each restriction piece 54 is formed so as to project along the axial direction X from the outer-peripheral wall portion 52, the embodiments are not limited thereto. The rear cover 5 may be in a configuration in which the outer-peripheral wall portion 52 is not included.

As in the foregoing, the connector 1 may constitute a connection mechanism for wiring-material-to-wiring-material connection capable of electrically connecting the wiring materials.

While it has been described that the terminal T is a female terminal, the terminal T may be a male terminal that is electrically connected to a female counterpart terminal.

As a reference example, the connector may have, in the relation among the housing, the front holder, and the rear cover, a configuration in which the front holder functions as the above-described restriction member. That is, in this case, the connector according to the reference example includes a housing that houses therein terminals along the axial direction, a front holder that is assembled to an end portion in the axial direction of the housing and holds the terminals between the housing and the front holder in the axial direction, and a rear cover that is assembled to an opening formed at an end portion on the opposite side to the front holder side of the axial direction in the housing and closes the opening. One of the housing or the rear cover has a latch claw portion that latches the housing and the rear cover, and the other of the housing or the rear cover has a latch arm portion that extends along the axial direction and is latched to the latch claw portion in a state where the housing and the rear cover are assembled. Then, the front holder, in a state of being assembled to the housing, functions as a restriction member, by having a restriction piece that is located adjacent to the latch arm portion in a state of being latched to the latch claw portion and restricts the displacement of the latch arm portion toward the latch release side. The connector in the reference example also makes it possible to assemble the components properly.

The connector and the wire harness according to the present embodiment include the housing, the front holder, and the restriction member. The housing and the front holder are assembled to each other when the latch claw portion and the latch arm portion are latched together. The restriction member can, in a state of being assembled to the housing, restrict by the restriction piece the displacement of the latch arm portion that is in a state of being latched to the latch claw portion toward the latch release side. With this configuration, the connector can properly maintain the state where the latch arm portion and the latch claw portion are latched and maintain the state where the housing and the front holder that are the components are properly assembled. As a result, the present invention has an effect that allows the connector and the wire harness to assemble the components properly.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a housing configured to house therein a terminal along an axial direction;

a front holder assembled to an end portion in the axial direction of the housing, the front holder being configured to hold the terminal between the housing and the front holder in the axial direction; and a restriction member assembled to the housing, wherein one of the housing and the front holder includes a latch claw portion configured to latch the housing and the front holder, the other of the housing and the front holder includes a latch arm portion extending along the axial direction, the latch arm portion being configured to be latched to the latch claw portion in a state where the housing and the front holder are assembled, and the restriction member includes, in a state of being assembled to the housing, a restriction piece that is located adjacent to and overlapping the latch arm portion that is in a state of being latched to the latch claw portion, the restriction piece restricts displacement of the latch arm portion toward a latch release side by overlapping the latch arm portion.

2. The connector according to claim 1, wherein the housing includes an opening formed at an end portion on the opposite side to the front holder side in the axial direction, and the restriction member is assembled to the opening and closes the opening.

3. The connector according to claim 2, wherein the restriction member includes an outer-peripheral wall portion formed around an axis along the axial direction, and the restriction piece is formed so as to project along the axial direction from the outer-peripheral wall portion.

4. The connector according to claim 3, further comprising:

a water stop member that is annularly formed and is attached to an outer circumferential surface of the outer-peripheral wall portion of the restriction member.

5. The connector according to claim 4, wherein the water stop member is interposed between the outer circumferential surface of the outer-peripheral wall portion and a wall surface of the opening and comes into contact with the wall surface of the opening when the restriction member is assembled to the opening.

6. The connector according to claim 1, wherein the restriction member includes an outer-peripheral wall portion formed around an axis along the axial direction, and the restriction piece is formed so as to project along the axial direction from the outer-peripheral wall portion.

7. The connector according to claim 1, wherein the latch claw portion protrudes from an inner wall surface of the one of the housing and the front holder.

8. The connector according to claim 1, wherein the latch claw portion protrudes on an inner side along a width direction from an inner wall surface of the housing.

9. The connector according to claim 1, wherein the latch claw portion is provided on an inner wall surface in a width direction of a body portion of the housing, and the latch arm portion is formed on an end wall portion of the front holder.

10. A wire harness comprising:

a wiring material having conductivity; and a connector electrically connected to the wiring material, wherein the connector includes a housing configured to house therein a terminal electrically connected to the wiring material along an axial direction, a front holder assembled to an end portion in the axial direction of the housing, the front holder being configured to hold the terminal between the housing and the front holder in the axial direction, and a restriction member assembled to the housing, one of the housing and the front holder includes a latch claw portion configured to latch the housing and the front holder, the other of the housing and the front holder includes a latch arm portion extending along the axial direction, the latch arm portion being configured to be latched to the latch claw portion in a state where the housing and the front holder are assembled, and the restriction member includes, in a state of being assembled to the housing, a restriction piece that is located adjacent to and overlapping the latch arm portion that is in a state of being latched to the latch claw portion, the restriction piece restricts displacement of the latch arm portion toward a latch release side by overlapping the latch arm portion.

* * * * *